US011358784B2

(12) United States Patent
Vanderstraeten et al.

(10) Patent No.: US 11,358,784 B2
(45) **Date of Patent: *Jun. 14, 2022**

(54) DISC-SHAPED PRESSURE CONTROL DEVICE FOR PRESSURE PACKAGING

(71) Applicant: Gojara bvba, Destelbergen (BE)

(72) Inventors: Erwin Vanderstraeten, Gentbrugge (BE); Dirk De Cuyper, Destelbergen (BE); Tom Anthierens, Destelbergen (BE)

(73) Assignee: GOJARA BVBA, Destelbergen (BE)

( * ) Notice: Subject to any disclaimer, the term of this patent is extended or adjusted under 35 U.S.C. 154(b) by 49 days.

This patent is subject to a terminal disclaimer.

(21) Appl. No.: 16/500,356

(22) PCT Filed: Apr. 3, 2018

(86) PCT No.: PCT/IB2018/052287

§ 371 (c)(1),
(2) Date: Oct. 2, 2019

(87) PCT Pub. No.: WO2018/185652

PCT Pub. Date: Oct. 11, 2018

(65) Prior Publication Data

US 2021/0101738 A1 Apr. 8, 2021

(30) Foreign Application Priority Data

Apr. 3, 2017 (BE) ..... 2017/5233

(51) Int. Cl.
*B65D 83/66* (2006.01)
*B65D 83/64* (2006.01)

(52) U.S. Cl.
CPC ..... *B65D 83/663* (2013.01); *B65D 83/64* (2013.01)

(58) Field of Classification Search
CPC . B65D 83/42; B65D 83/425; B65D 83/60–66
See application file for complete search history.

(56) References Cited

U.S. PATENT DOCUMENTS

2007/0125809 A1* 6/2007 Regan ..... G05D 16/10 222/389
2015/0300568 A1* 10/2015 Smits ..... F17C 1/00 53/440

(Continued)

FOREIGN PATENT DOCUMENTS

BE 1003980 A3 7/1992
DE 42 41 074 A1 1/1994

(Continued)

OTHER PUBLICATIONS

International Search Report in International Applicatuon No. PCT/IB2018/052287, dated Jul. 30, 2018.

(Continued)

*Primary Examiner* — Paul R Durand
*Assistant Examiner* — Randall A Gruby
(74) *Attorney, Agent, or Firm* — Knobbe Martens Olson & Bear LLP

(57) ABSTRACT

A pressure control device for pressure packaging based on a disc with fluid connection and a collecting basin, with associated closing means. The closing mechanism in the pressure control device is no longer based on a cylinder with a central opening in the separation wall and closing-off of the opening by means of a piston with stem. The proposal is extremely simple, compact and easy to assemble. The use of O-rings is superfluous. A method for manufacturing a pressure control system and a kit of parts for the assembly thereof.

4 Claims, 7 Drawing Sheets

(56) References Cited

U.S. PATENT DOCUMENTS

| | | | | |
|---|---|---|---|---|
| 2016/0159556 | A1* | 6/2016 | Brouwer | B65D 83/663 222/399 |
| 2017/0327302 | A1* | 11/2017 | Brouwer | B65D 83/38 |
| 2018/0229920 | A1* | 8/2018 | Vanderstraeten | B65D 83/663 |
| 2018/0370150 | A1* | 12/2018 | Brouwer | B29C 65/1664 |
| 2021/0130079 | A1* | 5/2021 | Olberding | B65D 83/38 |

FOREIGN PATENT DOCUMENTS

| | | | |
|---|---|---|---|
| WO | WO 2013/082680 | A2 | 6/2013 |
| WO | WO 2015/008250 | A2 | 1/2015 |
| WO | WO 2017/080685 | A1 | 5/2017 |

OTHER PUBLICATIONS

PCT Written Opinion in International Applicatuon No. PCT/IB2018/052287, dated Jul. 30, 2018.

* cited by examiner

DISC-SHAPED PRESSURE CONTROL DEVICE FOR PRESSURE PACKAGING

This application is the U.S. National Phase under 35 U.S.C. § 371 of International Application PCT/ib2018/052287, filed Apr. 3, 2018, designating the U.S., and published in English as WO 2018/185,652 on Oct. 11, 2018, which claims priority to Belgian Patent Application No. BE2017/5233, filed Apr. 3, 2017, the entire content of which is incorporated herein by reference.

TECHNICAL FIELD

The invention relates to the field of pressure packaging, more in particular pressure control devices and systems for pressure packaging to allow maintenance of a constant pressure of fluid release.

BACKGROUND

Spray cans based on propellants are well-known. Propellants are noxious for the environment and are being banned. Often, the release pressure is not constant and the pressure decreases as the fluid in the pressure packaging decreases.

An alternative based on compressed air is well-known. This system as described in for example EP 1 725 476, is composed of a dispenser and a pressure control system provided in the form of a glass bell provided with an insert with a control system based on a large number of parts. The pressure is controlled by means of a valve mechanism, based on a piston with stem and O-ring.

The valve mechanism in this type of spray can, especially the O-ring, is sensitive to damage amongst other things on assembly. This can lead to instability in the working pressure, as a result of which the system sometimes fails. Moreover, the present mechanism requires an intensive production process because of the large number of parts.

An additional disadvantage of this system is the fixed volume of the bell-glass. Once the bell-glass has been produced, the volume cannot be changed any more. For each desired volume, another injection mould must be used. This is expensive in terms of production cost and changeover times.

In WO 99/62791 and WO 2013/082680, a disc-shaped pressure control system is presented. This offers more flexibility as to the volume of the chamber in which the propellant is stored. However, for the pressure control, both systems are based on a piston with stem whereby the stem moves through an O-ring for opening or closing of the storage chamber with propellant. It is very important that the O-ring is not damaged. Very small incisions can already have a detrimental effect on the life span of the pressure packaging, because propellant can escape and the reference pressure decreases gradually. The movement of the stem through the ring causes rolling and friction, which influences the life span of the pressure control system. Additionally, the pressure reference chamber is closed off with an O-ring.

Consequently, there is a need for further alternatives and improvements. The present invention aims to solve one or more of the above-mentioned problems. The aim of the invention is to provide a robust pressure control system that can be assembled in an easy way, with less parts and an improved sealing.

SUMMARY OF THE INVENTION

The present invention thereto provides a pressure control device with a disc and a closing means, based on an alternative, improved and reliable pressure control mechanism. The number of parts was drastically reduced. O-rings can be avoided.

More in particular, the invention provides a pressure control device part according to claim 1 and a corresponding closing means according to claim 6. Together, the parts are part of a new and inventive pressure control device according to claim 11, a pressure control system according to claim 12 and a kit according to claim 15.

The closing mechanism in the pressure control device is no longer based on a cylinder with a central opening in the separation wall for closing by means of a piston with stem. The proposal is extremely simple, compact and easy to assemble.

This assembly and the use in a container for formation of a pressure packaging has the following advantage:

- There is a saving as to raw materials, since a disc will be smaller and lighter than a pot or a glass bell. At the same time, a bottom part can be executed in a lighter way, as room for welding the pot is no longer required.
- Both have an economic (cost of raw materials) as well as an ecological (reduced consumption of plastics) advantage.

By using the disc-shaped pressure control system, the container is divided into at least two spaces: a part for storage of propellant and a part for storage and release of fluid, also called filling material in pressure packaging.

This system has the following advantage:

- By integrating the disc at a variable height in the container, a complete range of packaging volumes can be built with one single injection mould. For example, with a 53 mm diameter disc, a 100-125-150-185-200-220 ml packaging can be made by varying the height in the packaging. In the case of an injection moulded pressure chamber or pot, it is required in that case that a separate injection moulded product be made for each variant.

The present invention has the advantage that the pressure chamber can be formed by the container itself, and not by a separate inner container. This is not obvious, since an average PET container without auxiliary measures is not stable at a pressure of 8 bar and temperatures up to 55° C. Possibly, reinforcements are necessary hereto, or the pressure in the chamber in which the filling material is located, can be lowered. For bag-on-valve systems, this pressure is for example only 4 bar.

In a last aspect, the invention provides a method for manufacturing a pressure control system according to an embodiment of the invention, according to claim 16.

By positioning the disc in a fluid container at a desired height, a desired volume is determined for holding a propellant. The shape of the disc enables to work with injection moulding and a central injection point.

Additional preferred embodiments have been described in the dependent claims.

DESCRIPTION OF THE FIGURES

In FIG. 7, the fluid opening has a circumferential protrusion.

DETAILED DESCRIPTION OF THE INVENTION

Figure 1:
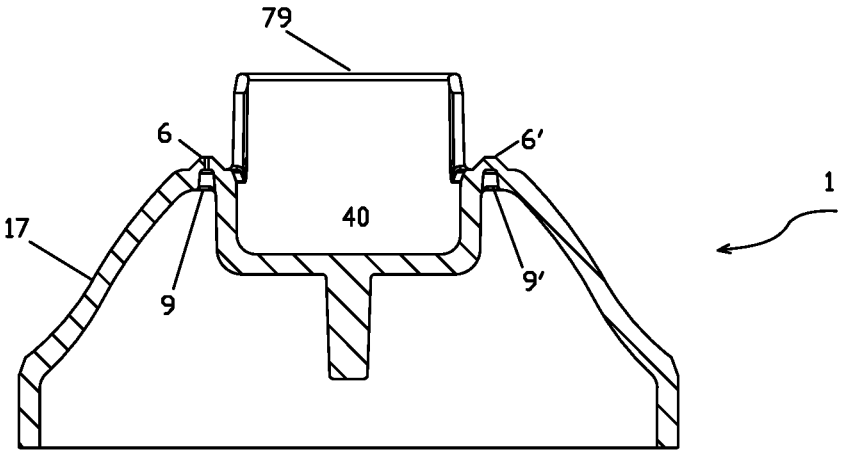
FIG. 1 is a first embodiment of a disc in bell shape according to the invention.

Unless otherwise specified, all terms used in the description of the invention, including technical and scientific terms, shall have the meaning as they are generally understood by the worker in the technical field the present invention relates to. Furthermore, definitions of the terms have been included for a better understanding of the description of the present invention.

As used here, the following terms shall have the following meaning: "A", "an" and "the", as used here, refer to both the singular and the plural form unless clearly understood differently in the context. For example, "a compartment" refers to one or more than one compartment.

"Approximately" as used here, that refers to a measurable value such as quantity, parameter, a quantity, a period or moment, etc., is meant to include variations of +/−20% or less, preferably +/−10% or less, more preferably +/−5% or less, still more preferably +/−1% or less, and even still more preferably +/−0.1% or less of the cited value, as far as such variations are appropriate for realizing the invention that is described. It will however be clear that the value to with the term "approximately" relates, will also be described specifically. The terms "include", "including" and "included", as used here, are synonym with "comprise", "comprising" and "comprises" and are inclusive of open terms that indicate the presence of what follows e.g. a component, and that do not exclude the presence of additional, non-said components, characteristics, elements, members, steps, that are well-known from or described in the state of the art.

The citation of numeric intervals by means of end points includes all integers and fractions included within that interval, including these end points.

The term "fluid", as used here, means a substance, such as a liquid or a gas, that can flow, has no solid shape and offers little resistance to an external tension.

The inventors found solutions to solve the problems with pressure packaging in the state of the art. The improvement consists of new parts for a pressure control device and system. The result is a compact and robust pressure control system that can be assembled in an easy way, with less parts and improved sealing.

The invention relates to a pressure control device part comprising a fluid connection and a collecting basin, preferably in a cylindrical, elliptic or oblong shape, with an open end and a closed end, provided for receiving a closing means of the collecting basin with one or more sealing means for closing off and releasing the fluid connection, wherein said pressure control device part is configured in the shape of a disc and said disc can be positioned and attached within a fluid container, thus defining a storage chamber that can be filled with a propellant for pressure control and for maintaining a constant predetermined pressure for releasing a fluid that is enclosed in the fluid container, characterized in that the closed end of the collecting basin is a full separation wall with said storage chamber and the fluid connection is provided outside of the collecting basin.

Preferably, the disc is plate-shaped or bell-shaped. A plate shape occupies the least space. A bell shape has the advantage that it offers support when a movable piston is used. This also enhances a compact assembly. The pressure control device part preferably has a height of maximum 2.5 times, more preferably 2.0 times, most preferably 1.5 times the height of the collecting basin including possible upstanding walls.

This has the big advantage that on the one hand, the disc is a part that is cheaper to produce than a bell-glass-shaped pressure chamber and that on the other hand, it is also more compact, easier to stack, and it could thus save costs for transport. Also, no insert is needed. The volume of the chamber for storage of propellant is controllable by means of this part. The pressure control device part can be made of one piece, by injection moulding, preferably with a central injection point. This is advantageous for the strength of the collecting basin. Preferably, the collecting basin has the shape of a cylinder or oblong body.

The closure is preferably situated right opposite to the fluid connection. The fluid connection preferably follows the longitudinal axis of the fluid container. In another embodiment, the fluid connection is realized in an oblique way with respect to the longitudinal axis of the fluid container.

Preferably, the fluid connection is provided with a circumferential protrusion extending from the outside of the wall of the disc in the direction of the top of the fluid container where fluid can leave the container; preferably extending at a height H1 of 0.1-2.0 mm; more preferably with a height H1 of 0.2-1.8 mm; still more preferably 0.3-1.6 mm; most preferably 0.4-1.4 mm. Preferably, the protrusion is a bump, truncated cone shape, cube shape or a rectangular shape. The protrusion can also be provided by a needle that was introduced in the fluid opening.

The pressure control device part is preferably provided with one or more liquid locks. A liquid lock prevents access to an opening, in particular the fluid connection.

A liquid lock can be used as an alternative to a piston. Both embodiments avoid that fluid can come into the fluid connection. A combination of a liquid lock and a dip tube is advantageous for low viscosity fluid. Otherwise, the low viscosity product could come in the fluid connection. In the case where a liquid lock is used, it is avoided that liquid comes into the chamber under the disc, even when the stopper is in the "open" position, wherein the closing element does not close off the fluid connection.

In a preferred embodiment, the liquid lock consists of a piece of sealing material that is partially attached to the disc wall. This allows a rotational movement of the sealing materials as a result of which the fluid connection can open and close. Preferably, the fastening is done by welding, such as laser welding or ultrasonic welding or gluing.

The pressure control device part is preferably provided with one or more venting means. The use of a venting means in the pressure control device has the advantage that during the assembly of the parts, the reference chamber can remain opened, i.e. in contact with the atmosphere, not under pressure, but at atmospheric pressure. This is opposed to the "closed" position, wherein the reference chamber is closed off by a sealing means and is thus exposed to its own internal reference pressure. In closed position, the reference chamber is "activated".

This has some substantial advantages. As long as the pressure control device is "open", it is less sensitive to external manipulations such as further assembly, transport or storage. If the pressure control device would be closed, these manipulations could cause differences in the reference position or reference pressure of the stopper, for example, if it is not unusual that the empty devices are stored long-time for a period of up to one year or longer, between assembly and filling. The embodiment of the present invention with venting means allows the reference chamber to be "closed" at the moment of filling. As a synonym of venting means, the term ventilation means or vents can be used.

The venting elements can be positioned in the upper part of the collecting basin of the reference chamber. These venting means provide local interruptions in the cylindrical wall of the reference chamber. The stopper that is moving in the collecting basin, preferably the cylinder, is provided with a sealing mechanism, for example, an O-ring, that has a particular diameter biasing with the collecting basin for obtaining the closing of the reference chamber. By interrupting the upper part of the collecting basin with venting means, the sealing mechanism of the stopper still has the biasing with the collecting basin to keep it mechanically in its place, but it does not seal yet because of the venting means. Thus, the stopper can be introduced and can be kept in its place mechanically, while the reference chamber is kept open at atmospheric pressure (not activated). Only when the stopper is pushed further in the collecting basin, preferably the cylinder, towards a position below the venting means, will it effectively seal the reference chamber (activated).

The venting means can have different shapes and different numbers. A minimum of one venting means is preferred, more preferably two or more. Venting means can occur as a groove in the upper part of the cylinder wall. However, when the wall extends beyond the upper part of the room, they will be provided as an opening in the basin wall or the cylinder wall.

In an additional aspect, the invention provides a closing means, for receipt in a pressure control device part according to an embodiment of the invention, with one or more sealing means for closing off and releasing a fluid connection in the pressure control device part and a closure for the cylinder of the pressure control device part.

The closing means is preferably a stopper. Preferably, the stopper has the shape of a hat, with an uninterrupted edge or with an interrupted edge and the formation of "ears", also called collar parts. This entails material savings compared to a stopper where the collar extends along the periphery with the stopper neck. The material savings relate to the stopper material, but also to the closing element. The material of the closing element can be positioned very well and can be kept very local. A locally positioned sealing can be provided for example by a small cylinder, half of a cone shape or even a piece of tape.

When using a stopper with collar parts, it is advantageous to use a disc with guiding means for the collar parts. The pressure control device part is preferably provided with one or more guiding means for guiding the one or more collar parts. This is advantageous for positioning the closing means in the collecting basin.

An embodiment wherein the collecting basin is provided with an interrupted peripheral wall towards the top of the fluid dispensing container and at the same time the stopper is provided with radially extending protrusions, in the shape of "ears", that fit in the interruptions of this wall, is largely advantageous. This construction provides a guiding mechanism for the stopper. The guiding mechanism prevents tilting of the stopper. Since the tilting may have a very negative impact on the precision and efficiency of the pressure control device, it is advantageous that this can be avoided.

The closing means is preferably provided with a protrusion to act upon said fluid connection, more in particular the opening and closing of the fluid connection. Said protrusion preferably has a height H2 of 0.1-2.0 mm, more preferably a height H2 of 0.2-1.8 mm, more preferably 0.3-1.6 mm, most preferably 0.4-1.4 mm.

The closing means preferably comprises a collar or one or two collar parts, preferably two collar parts, to act upon the fluid connection; preferably to act upon the circumferential protrusion provided around the fluid connection.

In a preferred embodiment of the invention, the neck of the closing means is made of a sealing material. This is advantageous because no separate closure needs to be provided. The closure is an integral part of the closing means. The closing means and the closure are one single part. The number of parts is limited. This is an alternative for and preference over an embodiment wherein the neck of the closing means is provided with a sealing material for the collecting basin, such as a cylinder, such as an O-ring or X-ring.

In a preferred embodiment, the stopper is produced by means of a two-component injection moulding process, in which very locally and where sealing is required, a small amount of sealing polymer is injected, such as silicon or NBR.

Even more preferably, since the fluid connection is very small, the complete stopper can function as a closing element. This has the advantage that no separate closing element must be added for closing off the fluid connection since the stopper itself functions as a closing element.

More preferably, the collar or one or more collar parts and/or neck closing means, or the closing means, are provided with or made of an elastomer material.

The term elastomer, as used herein, means a rubbery material consisting of long chain-like molecules, capable of taking their original shape again after being largely extended—thus the name elastomer, from "elastic polymer". Elastomers are polyisoprene, the polymer part of natural rubber or plastic substances, such as styrene-butadiene rubber, butadiene rubber, acrylonitrile-butadiene copolymer (nitrile rubber), isobutylene-isoprene copolymer (butyl rubber), polychloroprene (neoprene), polysulfide (Thiokol), polydimethyl siloxane (silicone), fluoroelastomer, polyacrylate elastomer, polyethylene (chlorinated chlorosulphonated), styrene-isoprene-styrene (SIS, styrene-butadiene-styrene (SBS) block copolymer, EPDM polypropylen mixture. Said elastomer material is preferably a acrylonitrile butadiene rubber (NBR). It has the advantage that it is airtight. Another preferred elastomer is a fluoroelastomer, sold under the name Viton. Still more preferably, it is a thermoplastic elastomer. Most preferably a thermoplastic elastomer selected from the list: TPE-E (Thermoplastic Copolyester Elastomers), TPE-O (Thermoplastic Polyolefin Elastomers), TPE-S (PP based compounds with a rubber part), TPE-V (PP based compounds with a EPDM part), TPE-U (thermoplastic polyurethanes), TPE-A (thermoplastic polyamides). These materials can be processed easily via the technique of injection moulding in a cooled mould. This is contrary to silicon or NBR materials, that need to be vulcanized in a mould, which has a detrimental effect on the cycle time.

The Shore A scale is used for measuring the hardness of elastomers, rubbery materials and plastomer materials such as polyurethane. The higher the number, the harder the material. The measurement method for using a durometer is described in the ISO standard 7619-2010.

In a preferred embodiment, said elastomer material has a Shore A hardness of 50-100, more preferably 60-90, even more preferably 65-80, most preferably 70. An acrylonitrile butadiene rubber material with Shore A hardness of 70 or a fluoroelastomer with Shore A hardness of 75 is preferably used.

In a preferred embodiment of the invention, the closing means and the sealing material are made of the same material, preferably as one single piece. The closing means is preferably made out of one single piece, preferably of an elastomer material, more preferably of an elastomer material with a Shore A hardness of 50 to 100, still more preferably of 60 to 90, most preferably of 65 to 80. In this way, the desired functionalities can be provided, namely acting upon the fluid connection and closing off the collecting basin (a cylinder), with one single part. This saves production steps. It strongly simplifies the construction.

In a further aspect, the invention provides a pressure control device for controlling a constant predetermined pressure in a pressure packaging, characterized in that it comprises a pressure control device part according to an embodiment of the invention and a closing means according to an embodiment of the invention, contained in the collecting basin, thereby defining a pressure reference chamber. Preferably, the collecting basin has a cylindrical shape, elliptical shape or an oblong shape.

The chamber preferably has a diameter of 15.0-30.0 mm, preferably of 18.0-28.0 mm, more preferably 20.0-25.0 mm, most preferably 22.0-24.0 mm. The stopper preferably has a height h of 5.0-15.0 mm, more preferably 7.0-13.0 mm, more preferably 8.0-12.0 mm, even more preferably 9.0-11.0 mm, most preferably 10.0 mm. The relatively large diameters have the advantage that friction on the closing means of the stopper neck is minimized.

In a further aspect, the invention provides a pressure control system comprising a container and a pressure control device according to an embodiment of the invention, characterized in that the container is capable of withstanding the pressure controlled by the pressure control device; preferably, said container is a metal container or a plastic container, more preferably a PET container, most preferably a PET container obtained by injection-stretch-blow moulding (ISBM).

Injection-stretch-blow moulding comprises the following steps: injection moulding of a preform, stretch blowing of the preform in a container mould, cutting off of the lower or upper part to obtain an opening for introduction of the disc-shaped pressure control device.

As an alternative, the container can be made from other biaxially stretchable plastic materials, such as polyethylene naphthalate (PEN), polyethylene-coisosorbite terephtalate (PEIT), polytrimethylene furan dicarboxylate (PTF), high-density polyethylene (HDPE), polyproplyene (PP), polyamides, polystyrene, polyvinyl chloride (PVC), cyclic olefin polymer (COC), or a combination thereof.

In another embodiment, the container could have been made by means of an extrusion process. In this case, a tubular part is extruded and cut off/closed off to the desired length. This has the advantage that no residual material is cut off, contrary to the cutting-off of the bottom of containers that are manufactured by an ISBM process. This cutting-off of the bottom is waste that is expensive. If the container tube is manufactured by means of extrusion, a separate additional part must be added to be able to close.

In a preferred embodiment, the pressure in the propellant storage chamber and the part where the filling material is stored, has a ratio of 4:1 to 3:1. The propellant storage area is usually under a pressure of 6 to 8 bar and the pressure inside the fluid container in the part containing the filling material is typically 2 bar.

A dispenser with a content of 200 ml usually has an actual content of 240 ml of liquid and 80 ml of propellant. The 80 ml propellant is brought under pressure to 8 bar. It can deliver 2 bar to push the total content of 320 ml outside and to empty the container.

Preferably, the container in the pressure control system is provided with a dome-shaped piston that is appropriate for separating fluid and propellant, and that is movable towards a release opening of the container by means of the excessive pressure prevailing in the container, characterized in that the dome is form-matching with the top part of the container and/or with the pressure control device part.

The movable piston is preferably configured as a dome with ring-shaped ribs. This enhances the mobility and at the same time, the piston still ensures the separation between fluid or filling material and propellant, preferably a propellant gas, most preferably compressed air. As an alternative for compressed air, other propellant gases can be used such as $N_2$, $CO_2$ or $NO_2$ or liquid propellants such as isobutene or isopentane.

An alternative for providing a separation between the filling material and propellant is the execution of the container as a bag-on-valve system. Hereby, on a release opening, a dosing valve is mounted with a bag attached thereto for enclosing the filling material. In this way, it does not come into contact with the propellant. In case compressed air is used as propellant, a solution is offered for filling materials that are sensitive to air exposure, especially to oxygen.

Preferably, the container is attached to the disc by means of a permanent connection. This can be achieved by welding, preferably laser welding. Preferably, the disc is attached to the wall with a double seam. This provides additional strength.

The disc is preferably realized in laser weldable material. This can be achieved for example by providing a plastic composition with carbon black.

The invention also provides a kit of parts for manufacturing a pressure control device according to the invention comprising a pressure control device part according to an embodiment of the invention, and a closing means according to an embodiment of the invention.

In a last aspect, the invention provides a method for manufacturing a pressure control system according to an embodiment of the invention, comprising the following steps:

providing a disc comprising a collecting basin with an open and an closed end according to an embodiment of the invention, taking up a closing means according to an embodiment of the invention in the collecting basin, attaching the disc to the wall of a fluid container.

The collecting basin preferably has a cylindrical shape, an oblong shape or an elliptical shape. The shape is preferably included in the fluid container before it is attached to the wall of the fluid container.

The choice of a disc and closing means according to the embodiment of the invention has the advantage that one can choose for a static instead of a dynamic sealing. This is a more robust, more reliable way of sealing and is less sensitive to damage and wear.

The disc can be made by means of injection moulding, punching or thermoforming. Injection moulding is preferred. The fluid connection can be made afterwards, for example by drilling one or more holes through the disc wall. If desired, the mould for injection moulding can be equipped for direct production of a disc with one or more holes. Preferably, the injection mould is made of a plastic composition based on polyethylene terephthalate (PET). If required, reinforcement means can be added to the composition, such as glass fibres or impact modifiers. The choice of the dimensions of the collecting basin and the height of the closure determine which reference pressure can be set.

The design of the disc, in particular the full wall in the collecting basin as a separation wall with the chamber for storage of the propellant, ensures that a central injection point can be used in the injection moulding process.

The attachment is preferably made by welding, more preferably laser welding. Thereto, carbon black can be provided in the disc. The positioning of the disc, prior to the attachment, defines the volume that is desired for storage of a propellant, after production of the pressure control device.

Preferably, the container is filled with filling material via a container opening opposite to the bottom or the bottom part.

If required, the pressure chamber is still provided with a bottom part. Preferably, a plug is taken up in the bottom part. The propellant is preferably introduced via a plug in the bottom part. The propellant can flow from the fluid opening to the filling material. When the pressure in the upper chamber pushes the closure in the collecting basin, the fluid connection is thereby closed off. The propellant can be compressed until a desired pressure in the lower chamber is reached.

When the pressure in the fluid container decreases below the predetermined pressure as set in the closed collecting basin, for example by removing filling material via a dispensing head, the closure moves in the direction of the head and the fluid connection of the pressure control valve is released. Propellant flows from the storage chamber through the fluid connection. When the pressure on the other side of the disc reaches the predetermined pressure again, the closure is pushed in the direction of the fluid connection and closes it off.

The invention is further illustrated by means of figures. These are non-limiting.

In FIG. 1, a first embodiment of a disc in bell shape according to the invention is shown, referred to by the reference number 1. The disc has a diameter corresponding to the inner diameter of a container that will be provided as a pressure packaging. At the extremities, the disc is to be connected to the wall of the container. The disc can be positioned and fixed within a fluid container 60 that is configured for releasing a fluid enclosed in the container at a constant predetermined pressure that can be controlled with said disc 1 and container 60 provided with closing means 8. The container can for example consist of a spray can that is configured for releasing a fluid, filling the container, from the container at a predetermined pressure.

The disc 1 is provided with a cylinder 40 with an open end and a closed end. The cylinder 40 is provided for receipt of a closing means 8. Together with the disc, the closing means constitutes a reference chamber. Furthermore, the closing means is provided with one or more sealing means 7 for closing off a fluid connection 9 that is provided outside the cylinder in the disc 1. This constitutes a connection between a storage chamber underneath the disc and the space above the disc. Thanks to the position opposite to the one or more sealing means 7, a fluid connection can be closed off or opened. The relative movement of the closing means in the cylinder is determined by the pressure differential between the chamber with stored propellant and the space above the disc, where the filling material is stored.

Figure 2:
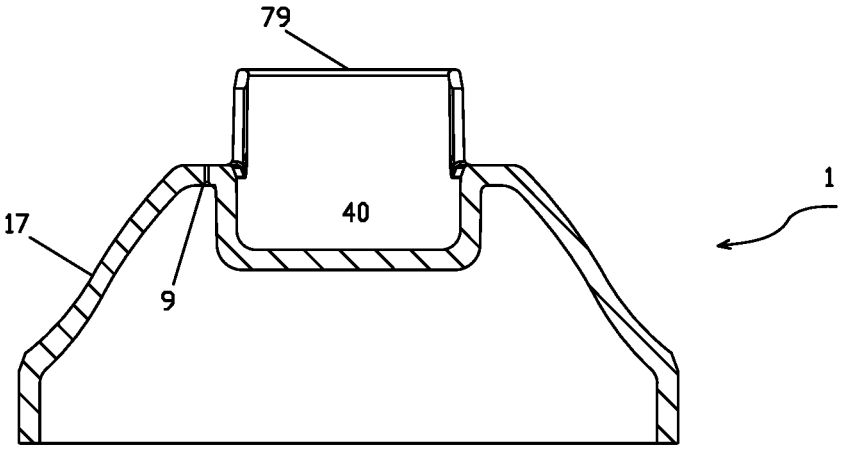
FIG. 2 shows a second possible embodiment of a disc in bell shape according to the invention.
Figure 3:
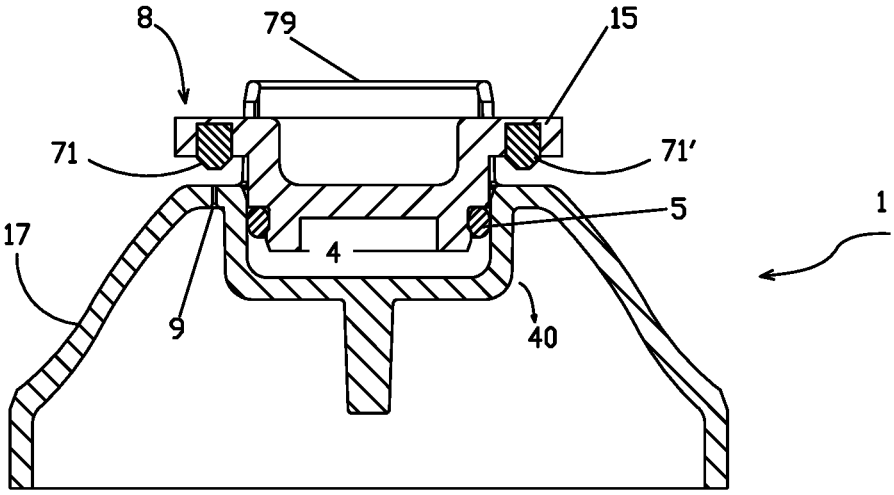
FIG. 3 is a first embodiment of a pressure control device according to the invention.
Figure 4:
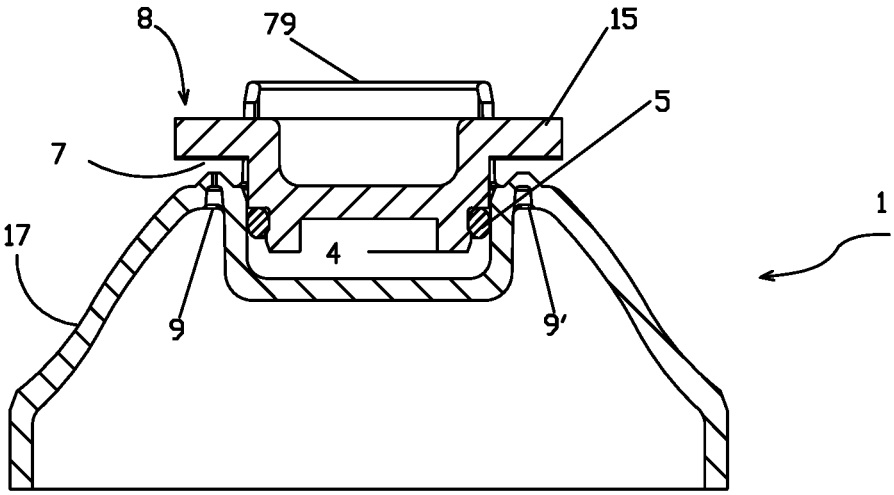
FIG. 4 shows is a second possible embodiment of a pressure control device according to the invention.

In FIG. 2, an alternative embodiment of a disc 1 according to the invention is presented. The fluid connection 9 in the disc, situated outside the cylinder 40, is not provided with a protrusion at the outer wall 17. To be able to close off this kind of fluid connection, the disc should be combined with a closing means offering a small surface capable of closing off the fluid connection. Possible combinations of closing means 8 and discs are shown in FIGS. 3 and 4. FIG. 3 shows a closing means 8 which constitutes a closed chamber 4 together with the disc and a closing ring 5. The closing means, here a stopper 8, can move up and down in the cylinder 40 when the disc is inserted in a container of a pressure packaging. The closing means in FIG. 3 is provided with a protrusion 71 that is applied opposite to the fluid connection 9 and that can close it off or open it. FIG. 4 shows a closing means 8 that can act upon a protrusion 6 that is provided on the outer wall 17 of the disc.

Figure 5:
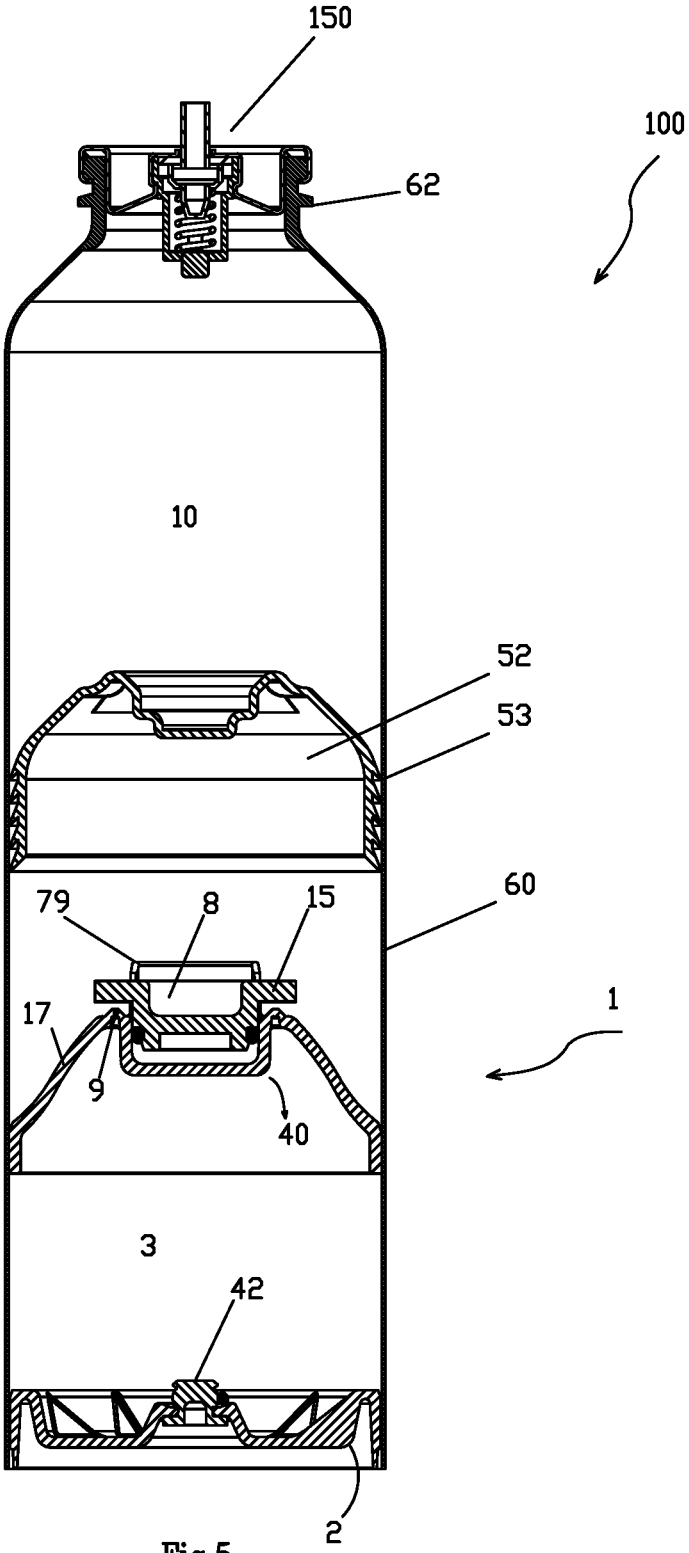
FIG. 5 is an embodiment of a pressure control system according to the invention. It comprises the pressure control device of FIG. 4. The figure shows an alternative embodiment of a pressure control system according to the invention. The container is closed off with a single piece stopper, made of elastomer.

FIG. 5 shows an embodiment of a pressure packaging or pressure control system 100 comprising a container that is provided with a disc 1 according to the invention and that is closed off with a bottom plate provided with a sealing 42. The container can be manufactured by means of injection-stretch-blow moulding (ISBM), for example by converting a plastic preform into a bottle shape. A desired container length can be obtained by sawing the bottom and/or by shortening the container along the longitudinal axis. A disc 1 according to the invention can be introduced at a desired height. By setting the height, the volume of the chamber 3 below the disc can be determined. The disc can be connected to the container by welding, preferably laser welding. To this end, it is advantageous that the connection parts in the disc are provided with a laser energy absorbing material. This can for example be a ring that is provided with graphite. The container can be closed off at the bottom with a bottom plate 2. Through a hole in the bottom plate that can be closed off with a sealing 42, a propellant can be introduced. Thereafter, the chamber 3 can be closed off. The propellant is preferably compressed air. This has the advantage that it is environment-friendly and cheap. The container 60 is provided at the top with a dispensing head 15. Above the disc 1, the container 60 is provided with a fluid that can be driven out of the container 60 under the pressure of the propellant. This fluid can be a gas, liquid or compressed solid. When activating the dispensing head 15, the propellant from the chamber above the disc 10 leaves the container 60. As a result of the relative pressure differential between this chamber 10 and the chamber underneath the closing means 4, the closing means 8 moves in the cylinder 40 in the direction of the dispensing head 15. Hereby, the connection is released between the chambers above 10 and below 3 the disc. From the supply of propellant in the lower chamber 3, propellant flows in the direction of the chamber above the disc 10 and closing means 8. When the pressure differential is almost equal, the closing means, preferably a stopper 8, moves back in the direction of the bottom of the container. Hereby, the connection 9 is closed again. The pressure for release is adjusted to the predetermined pressure. This process is so fast that the pressure for release of the filling material is almost constant.

Figure 6:
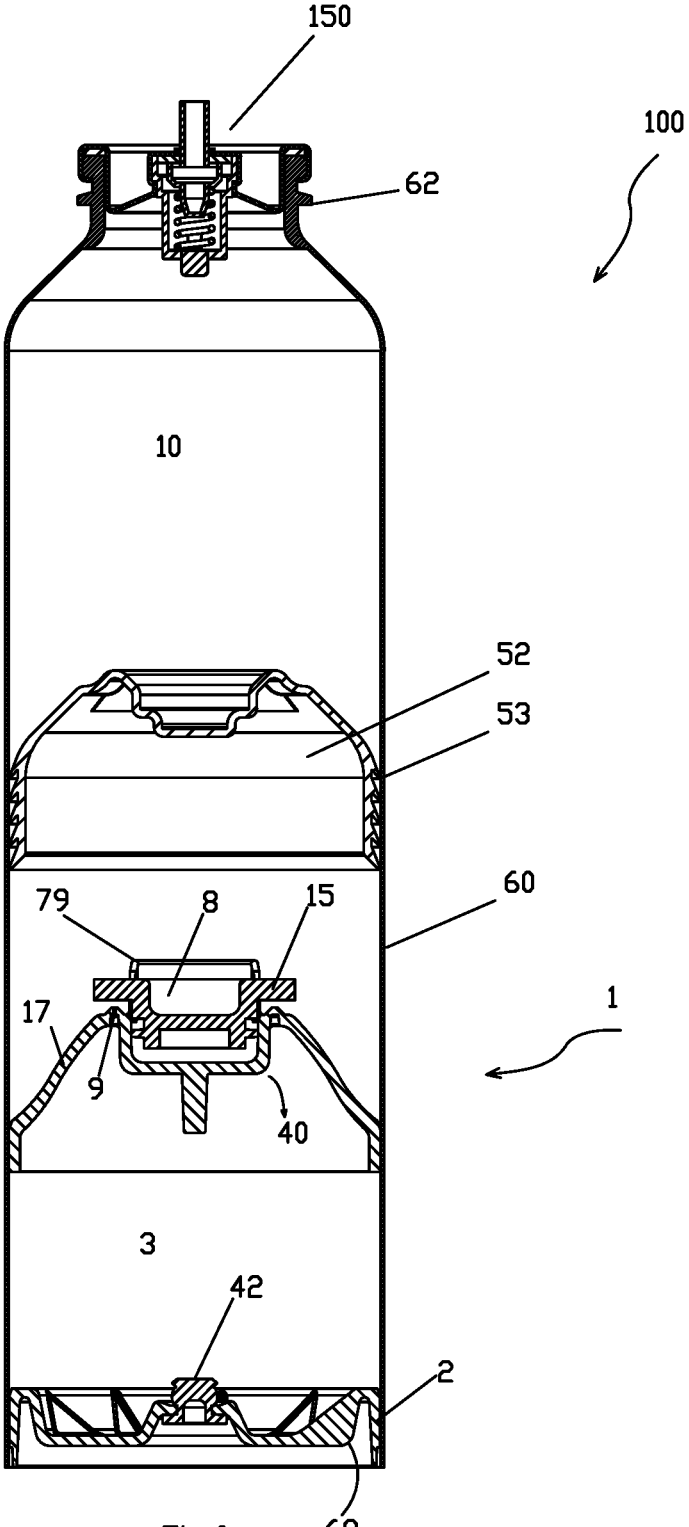
FIGS. 6 and 7 are representations of a pressure control device with a single piece stopper.

FIG. 6 shows an alternative embodiment of a pressure packaging or pressure control system 100 comprising a container 60 that is provided with a disc 1 according to the invention and that is closed off with a bottom plate 2 provided with a seal, in particular a Nicholson plug 42. The container was formed by blow moulding of a preform. At the top of the container, a neck opening 32 is shown with edges. They offer an attachment point for a pressure valve 150. The container is further provided with a dome-shaped piston 52, with ribbed edges 53. The dome shape is form-matching with the shoulder part of the container. The middle part of the piston has a recess taking into account the pressure valve at the top. This embodiment ensures that the piston can slide up to the top of the container. In this way, the filling material enclosed in the chamber 10 above the piston 52 can be emptied maximally from the container 60. The piston 52 is also form-matching with the dome-shaped pressure control device 1. The stopper is provided with a recess in which the one of the piston fits. The fluid connection 9 is provided outside the cylinder 40. The opening 9 in the disc wall 17 has a circumferential protrusion. This provides a small surface that can be sealed off by the collar 15 of the stopper, situated opposite to the fluid opening 9. The cylinder has an upstanding edge 79, extending above the disc. The edge is slightly curved and serves as an abutment for the stopper 8. The disc is manufactured by injection moulding. Centrally, the injection canal can still be seen. Below the disc, there is a chamber 3 for storage of propellant. This is closed off by a separate bottom part 2 with upstanding edges 69 serving as a reinforcement. Centrally in the bottom plate 2, a Nicholson plug is included.

Figure 7:
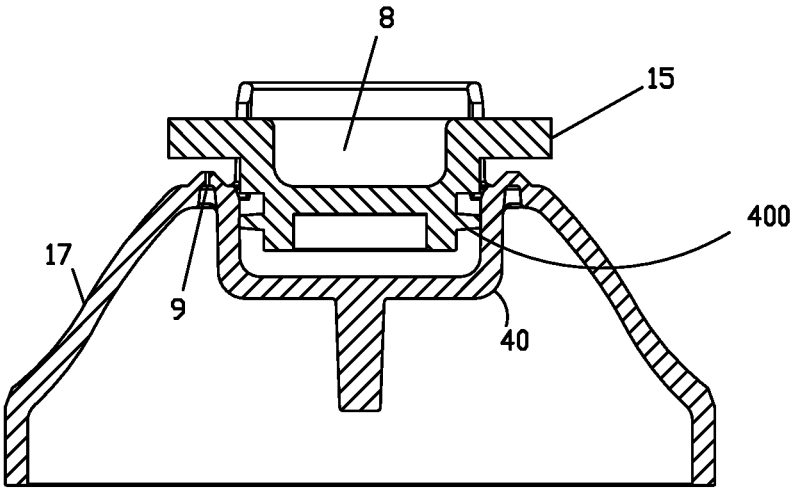

FIG. 7 shows a disc-shaped pressure control device with a single piece stopper. The fluid opening 9 has a circumferential protrusion.

Figure 8:
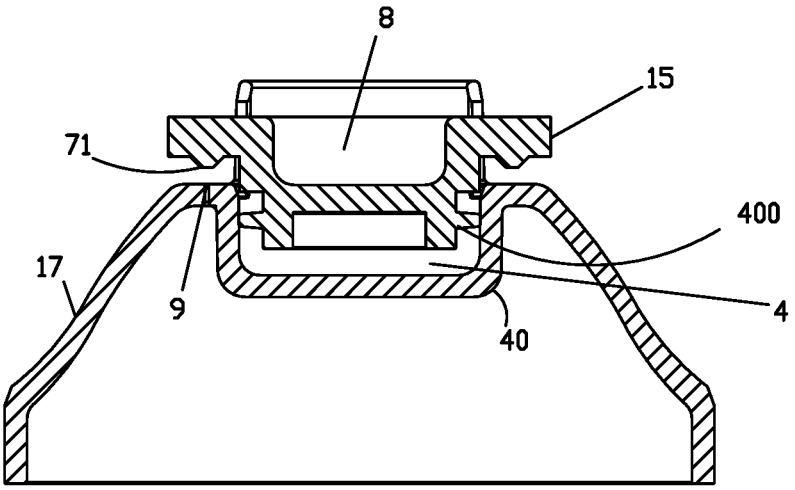
In FIG. 8, the protrusion is situated on a one-piece closure.

FIG. 8 is a representation of an alternative pressure control device with a single piece stopper. In this embodiment, the protrusion 71 is situated on the one-piece closure 8 opposite to the fluid opening 9.

Figure 9:
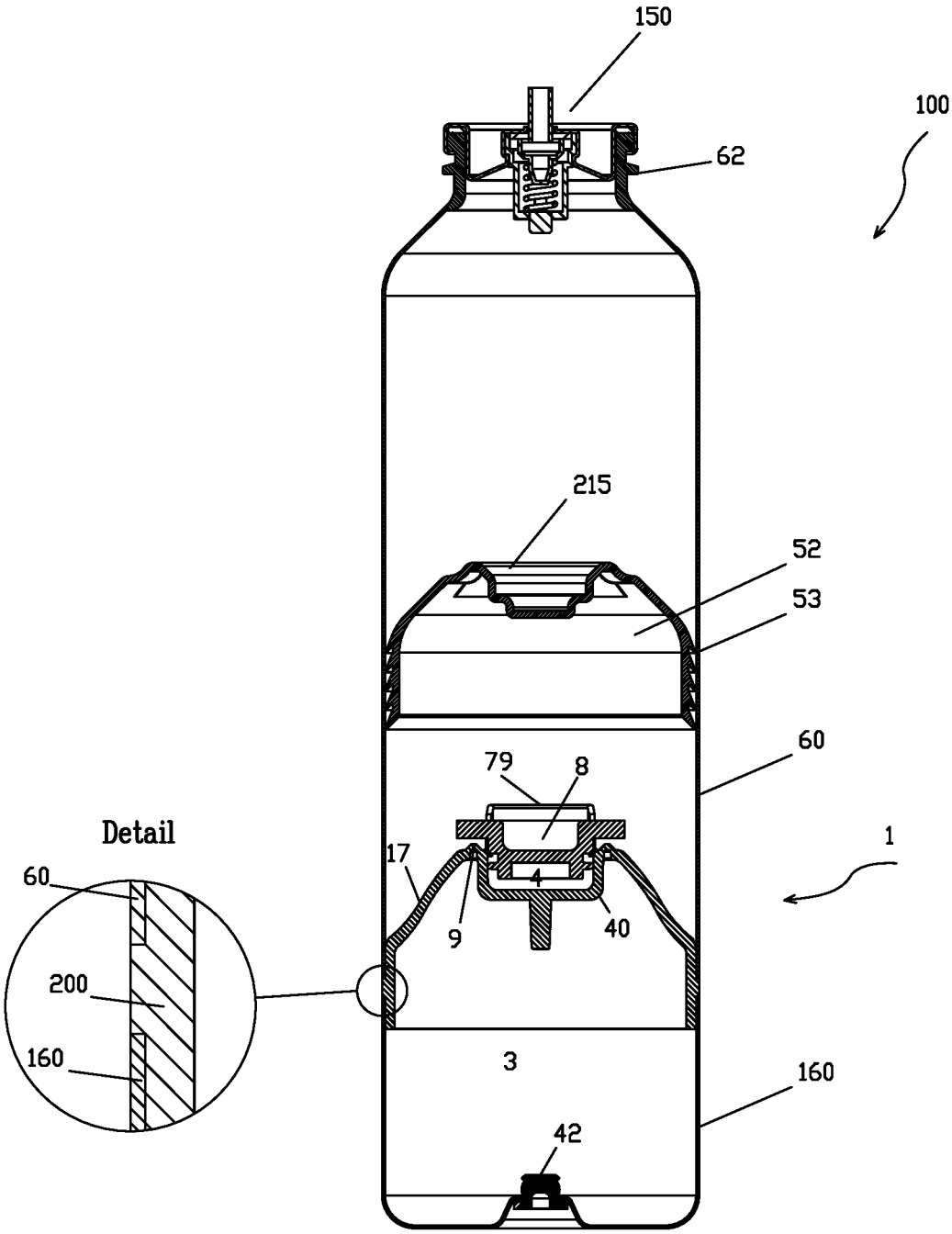
FIG. 9 is a representation of a pressure control system with disc-shaped pressure control device comprising a supporting point onto which a first container wall (60) is resting and is connected. The bottom part is constituted by the lower part of a container, of which the container wall (160) is in turn connected to the pressure control device.

FIG. 9 is a representation of a pressure control system with disc-shaped pressure control device comprising a supporting point 200 onto which a first container wall (60) is resting and is connected. The bottom is constituted by the lower part of a container 160, of which the container wall is in turn connected to the pressure control device.

Figure 10:
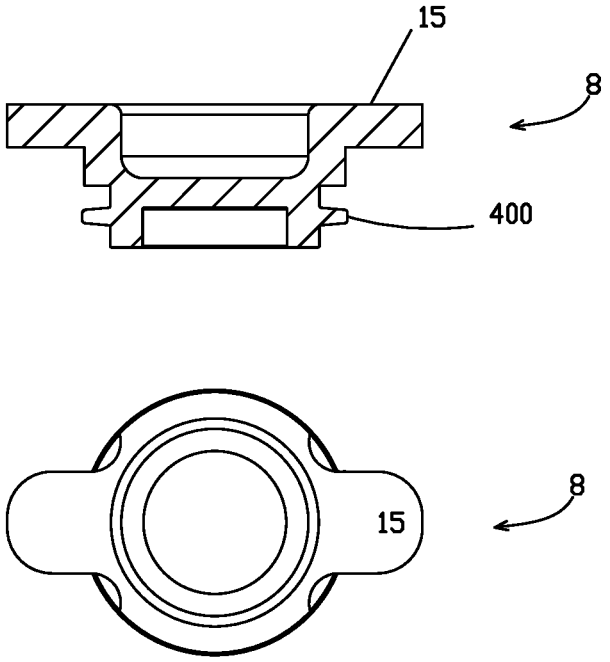
FIG. 10 is a representation of a one-piece stopper. It is made from a material that is appropriate for closing off a fluid opening as well as closing off a cylinder that functions as a reference pressure chamber.

FIG. 10 is a representation of a single piece stopper 8'. It is made of a material that is appropriate for both closing off the fluid opening and closing off a cylinder 40 by means of the edges 400 replacing an O-ring. The stopper comprises two collar parts 15, 15' and a closing edge 400.

Figure 11:
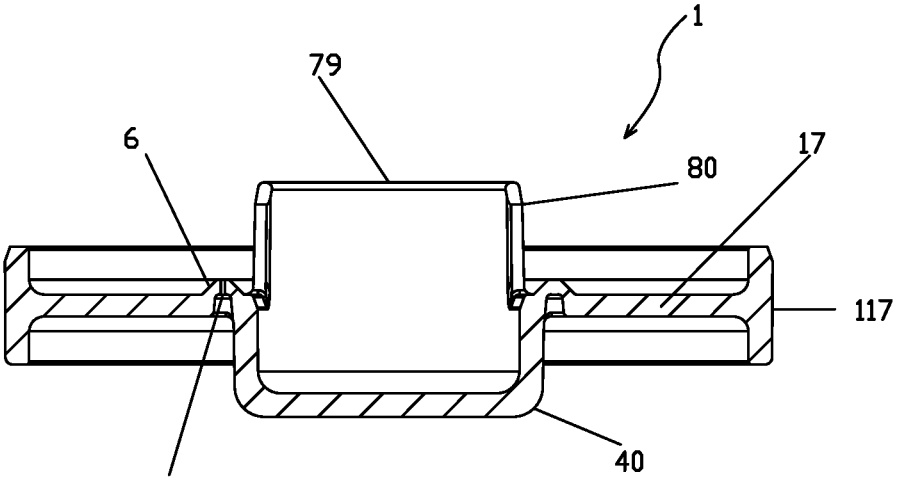
FIG. 11 is a representation of a sealing element in the shape of a substantially flat disc, meaning a plate shaped disc.

FIG. 11 is a cross-section of a sealing element 1 in the shape of an essentially flat disc. The upstanding edges 117 at the sides of the disc plate ensure a good attachment to a container wall 60. The upstanding edge 117 offers a concentric reinforcement of the container wall 60. The cylinder shown in FIG. 11 shows two recesses 85 in the upstanding walls of the cylinder 40. They ensure guiding of the collar parts 15, 15' of a form-matching stopper 8', such as the one shown in FIG. 10. The rounded edges 80 provide an opening that decreases as the stopper enters the cylinder. This disc can be manufactured by means of injection moulding from a plastic composition. If desired, chemical reinforcing substances can be added to the composition, such as for example glass fibres. Also, carbon black can be used, at least in the upstanding outer edge 117 to be able to attach the disc to a container wall by means of laser welding.

The invention claimed is:

1. A pressure control system comprising a fluid container and a pressure control device for controlling a constant predetermined pressure in a pressure packaging, comprising a pressure control device part comprising a fluid connection and a collecting basin with an open end and a closed end for receiving a stopper of the collecting basin, and a stopper taken up in the collecting basin, wherein the stopper comprises one or more seals for closing off and releasing the fluid connection in the pressure control device part and a closure for the collecting basin, thereby defining a pressure reference chamber, wherein said pressure control device part is configured in the shape of a disc and said disc is positioned within the fluid container and attached to the fluid container wall, thus defining a storage chamber that can be filled with a propellant for pressure control and for maintaining a constant predetermined pressure for releasing a fluid enclosed in the fluid container, wherein the closed end of the collecting basin is a full separation wall with said storage chamber and the fluid connection is provided outside the collecting basin, wherein the stopper is not a piston with stem whereby the stem moves through a ring and/or wall of the storage chamber for opening or closing thereof and the closure for the collecting basin is integrally part of the stopper, wherein the fluid container is capable of withstanding the pressure that is controlled by the pressure control device.

2. The pressure control system according to claim 1, wherein the fluid container has a dome-shaped piston suitable for separating fluid and propellant, and which is movable toward a release opening of the container by an excessive pressure in the container, wherein the dome is form-matching with a head part of the container and/or with the pressure control device part.

3. The pressure control system according to claim 1, wherein said fluid container is attached to said disc by welding.

4. A method for manufacturing a pressure control system according to claim 1, comprising:

providing the disc comprising the collecting basin with an open and a closed end;

taking the stopper up into the collecting basin and positioning the disc within the fluid container; and attaching the disc to the wall of a fluid container.

* * * * *